US006308485B1

(12) United States Patent
Blumenthal

(10) Patent No.: US 6,308,485 B1
(45) Date of Patent: Oct. 30, 2001

(54) PANEL AND METHOD FOR MOUNTING THE SAME

(75) Inventor: Hans-Georg Blumenthal, Neu Wulmstorf (DE)

(73) Assignee: Stora Kopparbergs Bergslags AB, Falun (SE)

( * ) Notice: Subject to any disclaimer, the term of this patent is extended or adjusted under 35 U.S.C. 154(b) by 0 days.

(21) Appl. No.: 09/446,874

(22) PCT Filed: Jun. 29, 1998

(86) PCT No.: PCT/SE98/01273

§ 371 Date: Mar. 27, 2000

§ 102(e) Date: Mar. 27, 2000

(87) PCT Pub. No.: WO99/00561

PCT Pub. Date: Jan. 7, 1999

(51) Int. Cl.[7] ..... E04C 3/00; E04D 1/36

(52) U.S. Cl. ..... 52/468; 52/465; 52/460; 52/461

(58) Field of Search ..... 52/468, 465, 460, 52/461

(56) References Cited

U.S. PATENT DOCUMENTS

| | | | | |
|---|---|---|---|---|
| 1,430,996 | | 10/1922 | Hörlin . | |
| 2,048,132 | | 7/1936 | Madsen . | |
| 2,754,776 | * | 7/1956 | Blaski | 108/13 |
| 5,403,414 | * | 4/1995 | Corston | 156/71 |
| 5,623,800 | * | 4/1997 | Shinkosky . | |
| 5,881,522 | * | 3/1999 | Dobija | 52/506.01 |
| 6,079,177 | * | 6/2000 | Halchuck | 52/506.06 |

FOREIGN PATENT DOCUMENTS

| | | |
|---|---|---|
| 2223151 | 11/1973 | (DE) . |
| 2240754 | 2/1974 | (DE) . |
| 9170 | 2/1912 | (GB) . |

* cited by examiner

*Primary Examiner*—Carl D. Friedman
*Assistant Examiner*—Chi Nguyen
(74) *Attorney, Agent, or Firm*—Burns, Doane, Swecker & Mathis, L.L.P.

(57) ABSTRACT

The present invention relates to a panel comprising a plurality of panel members (1) applied parallel to each other to a backing (2), spacers (4) which are applied to the backing between adjacent panel members in order to position the same (11) spaced from each other by a gap, as well as cover members (5) which are applied over the gap between two adjacent panel members and which have a width which is greater than the width of a spacer. The spacers (4) have a thickness which is different from that of the panel members (1) and on their rear face the cover members (5) exhibit a groove (6) or a ridge which is essentially as wide as the spacer and exhibits opposite limiting edges (8) which in coaction with edge portions of the spacer and of adjacent panel members respectively, achieve centering of the cover member over the spacer and the gap. The invention also relates to a method for mounting such a panel.

13 Claims, 2 Drawing Sheets

PANEL AND METHOD FOR MOUNTING THE SAME

Figure 1:
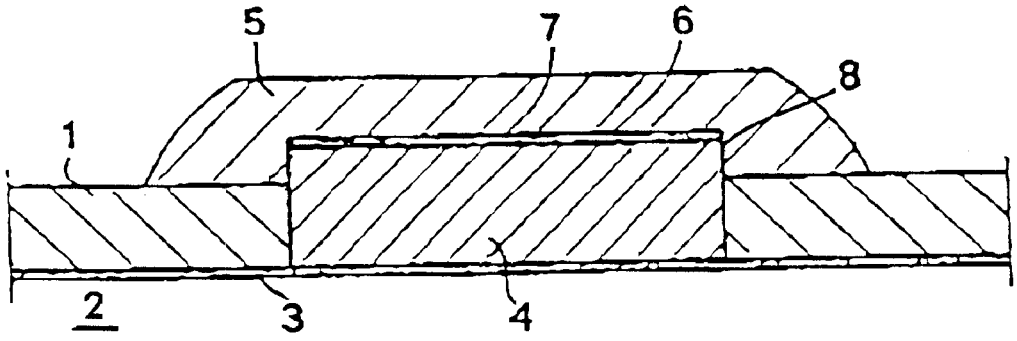

The present invention relates to a panel comprising a plurality of panel members applied to a backing, spacers applied to the backing between adjacent panel members in order to position the latter spaced from each other by a gap, as well as cover members which are applied to the panel members over the gap between two adjacent panel members and which have a width which is greater than the width of a spacer. The invention also relates to a method for mounting the same.

BACKGROUND OF THE INVENTION

The walls and the ceilings of buildings and rooms are often provided with panelling, made of, for example, wood or plastic laminate, in order to obtain surfaces with an aesthetically pleasing appearance. In order to reduce costs it is desirable that the panel can be mounted easily and quickly. High quality uniform wood, in particular, and other types of panel materials are expensive. There is thus also a need to limit the use of material as far as possible by making the panel as thin as possible.

Furthermore, it is usually desirable for the gaps or spaces which occur between adjacent panel members to be covered and a way of achieving this is to install so-called cover panelling of the type mentioned by way of introduction. A drawback of this type of panel is that it is difficult to centre the cover members exactly over the space between adjacent panel members and in cases where the appearance of the finished panelling is of great importance, careful measuring in of the position of the cover members is required prior to mounting. This type of operation is time-consuming and increases the total cost of the panel.

Moreover, particularly when installing wooden panels where the component boards and strips are very thin, it is difficult to find a suitable way of fastening them. In connection with nailing, there is a risk that boards will split, while screwing in pre-drilled holes is time-consuming and results in clearly visible screw heads. This generally applies to other types of panels as well.

DESCRIPTION OF THE INVENTION

The objects of the invention are to obviate the problems and drawbacks of the prior art cover panels and to provide a panel which can be quickly and easily mounted by virtue of permitting exact and immediate centring of the cover member over the spacer. At least these objects are achieved by means of a panel according to claim 1 and by means of a method according to claim 9.

A secondary object of the invention, in addition to providing even easier and quicker mounting, is to facilitate the use of very thin panel and cover members, with a preferred thickness of between 3 and 5 mm, by facilitating the use of double-sided adhesive tape as a fastening means in connection with mounting according to claim 10 without prior careful measuring in of the component parts of the panel in relation to each other.

The invention is thus generally applicable to panel members and cover members made of all types of materials. The panelling may, for example, be composed of conventional vertical, horizontal, or diagonal wood panelling with panel boards of varying width arranged in parallel and intermediate cover strips. The panel can also be made of other optional materials, e.g. plastic, laminate, sheet metal or combined materials such as, e.g., plastic and wood. Plate-shaped panel members of optional type which are framed by and separated by cover members can also be used. It is also possible to combine different panel members, e.g. plate-shaped and elongate ones, of which the latter may be orientated in parallel, transversely or obliquely in relation to the plate-shaped ones. This creates extensive possibilities for varying the design of the panel. Furthermore, the cover members are easy to replace and their colour and shape can be changed as needed.

U.S. Pat. No. 5,623,800 and GB 9170 A.D. 1911 disclose different types of prior art panels. However, in both these patent specifications, the panel members are not applied to the backing but to the respective spacer. This is a major drawback if very thin panel members are to be used since they will be arranged spaced from the backing and hence will not have the stability provided by the support of a posteriorly situated backing.

Furthermore, in U.S. Pat. No. 5,623,800 the cover members are not wider than the spacers and the spacers are not intended to be arranged between the panel members in order to position them spaced from each other but between the respective panel member and the backing in order to position the panel member at a certain distance from the backing. The cover members exhibit no groove or ridge, only fastening means 31, probably consisting of pins or nails, which are intended to be pressed into the spacers to fasten the panel members. Accordingly, the cover members do not exhibit a means for facilitating centring of the same over a spacer. While it is known from that specification to apply the spacers by means of double-sided adhesive tape to the backing, neither the panel members nor the cover members are applied by means of double-sided adhesive tape, nor would this be possible without previous careful measuring in of each of the component parts of the panel prior to mounting.

Nor are the cover members wider than the spacers in GB 9170 A.D. 1911, but rather a flanged portion of the latter projects below adjacent panel members and thereby positions them at a certain distance from the backing. While it would be possible to fasten all the component parts of the panel by means of double-sided adhesive tape, this would require very careful measuring in of the spacers in relation to each other prior to applying the panel and cover members.

The point of departure for composing the main claims 1 and 9 according to the present invention was that the closest prior art is the type of panel which is used as an exterior covering on buildings, which is known as "cover boarding" and which includes panel boards separated by distance boards of equal thickness which are covered by cover boards which are also of equal thickness but which are somewhat wider than the distance boards.

Unlike this type of panel and the panels disclosed in the above-mentioned patent specifications, the panel constructed according to the features in claim 1 of the present application has several advantages. The panel can be quickly and easily installed, e.g. with the aid of double-sided adhesive tape, without prior measuring in of the component parts of the panel in relation to each other. This method is defined in claim 9 and no prior art panel can be installed according to this method. Another important advantage in comparison with the above-mentioned patent specifications is that the panel members are mounted on the backing which gives the panelling the required stability even if the panel members are very thin.

The invention enables in a simple way quick and exact centring of the cover member over the gap by virtue of the spacers being either thinner or thicker than the panel members and if the spacer is thinner, the cover member exhibits a ridge on its rear face, while if the spacer is thicker, the spacer exhibits a groove on its rear face. In this connection, the side edges of the groove or the ridge will engage with or coact with the side edges of the spacers or the side edges of adjacent panel members. In this connection, the cover member shall be wider than a spacer and a groove of the cover member should be as wide as or slightly wider than the spacer while a ridge of the cover member shall be as wide as or slightly narrower that the spacer.

A panel designed in this way can be fastened by means of an optional fastening means, such as e.g. nails, screws or glue, but it has the further advantage that it facilitates the use of double-sided adhesive tape as a fastening means when mounting the panel, since one characteristic of double-sided adhesive tape is that it "catches" immediately leaving no possibility for adjusting the position as is the case in connection with, for example, nailing and gluing. It would, for example, be possible to design the cover member in the form of a T-shaped section whose transverse portion serves as a cover while the stem serves as a spacer and has a length corresponding to the thickness of the panel member so that it can be fastened on the double-sided adhesive tape to the backing. This would mean, however, that it would be necessary to displace the panel member installed subsequent to the T-section sideways a certain distance subsequent to applying it to the double-sided adhesive tape, which is not possible. Another alternative would be for the spacer to have the same thickness as the panel members and for the cover, with a flat underside, to be applied by means of double-sided adhesive tape to the spacer. However, this would render centring of the cover before the double-sided adhesive tape adheres more difficult. By designing the panel in accordance with the present invention the problems associated with the use of double-sided adhesive tape as a fastening means are obviated.

Double-sided adhesive tape is particularly interesting in connection with the installation of very thin panels and cover members and especially when these are made of wood.

The panel can be made with different materials in different parts. For example, it is possible to use wood in the panel and cover members while the spacer is made of, e.g., plastic or wood fibre. According to a preferred embodiment, the spacers are designed in the form of short pieces which are placed only where double-sided adhesive tape is applied to the backing. In this way, less material is used and the panel will have head gaps between adjacent panel members which may be advantageous in preventing moisture and mildew problems on, e.g., cellar walls. In order further to facilitate air circulation, the spacers could be designed with through holes or channels. One way of achieving this could be to manufacture the spacers from corrugated cardboard. Preferably, the spacers are delivered with double-sided adhesive tape on the outside. In that case, the double-sided adhesive tape is provided with a protective layer which is removed prior to mounting the cover member.

If the spacers are thicker than the panel members and the cover members exhibit grooves on their rear face, the groove should be of equal or somewhat smaller depth than the excess dimension of the spacers in relation to the panel members. This is to enable engagement of the double-sided adhesive tape prior to or at the latest in connection with the spacers bottoming against the panel members.

For the same reason, if the spacers are thinner than the panel members and the cover members exhibit a ridge on their underside, the thickness of the ridge should be as great as or somewhat greater than the difference in thickness between the spacers and the panel members. The inward-facing surface of the ridge as well as the groove should be flat to ensure good adherence to the double-sided adhesive tape.

An advantage of designing the cover members with grooves and making the spacers thicker than the panel members is that the volume of high quality, visible material in the cover members is extremely small and instead a greater material volume is placed in the spacers which are not visible in the finished panel and which can thus be made of a less costly material. On the other hand, an advantage of designing the cover members with a ridge is that centring the same over the spacers becomes easier. For example, there is no risk that the portions of a cover member adjacent to the ridge will adhere to the double-sided adhesive tape.

BRIEF DESCRIPTION OF THE ACCOMPANYING DRAWINGS

The drawings show, in

Figure 2:
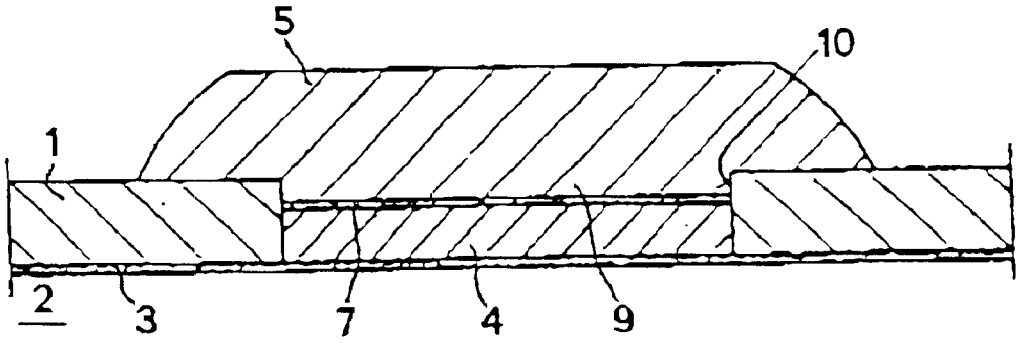
Figure 3:
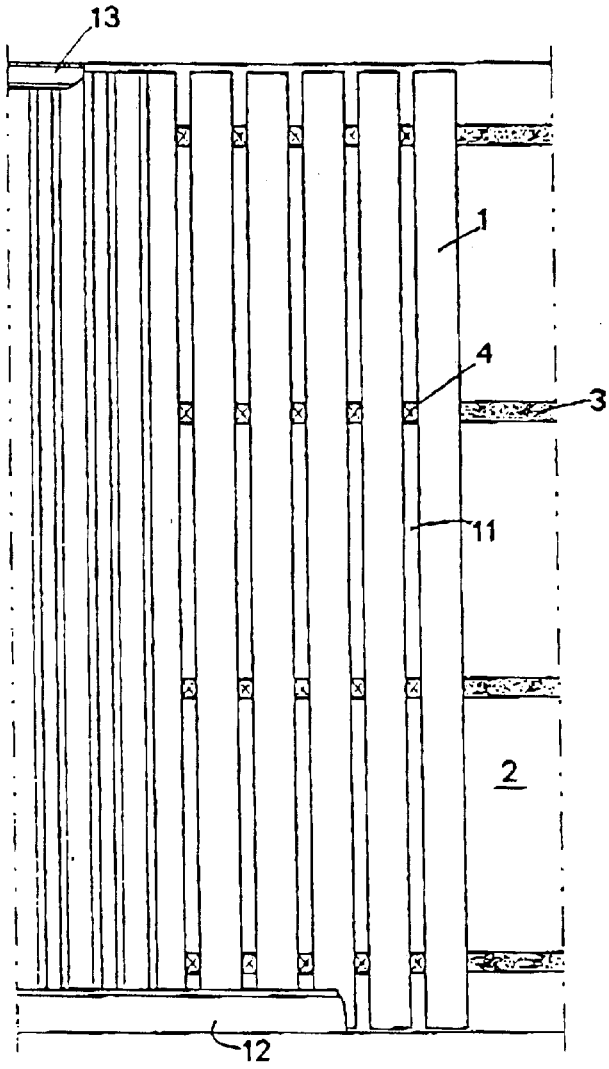
Figure 4:
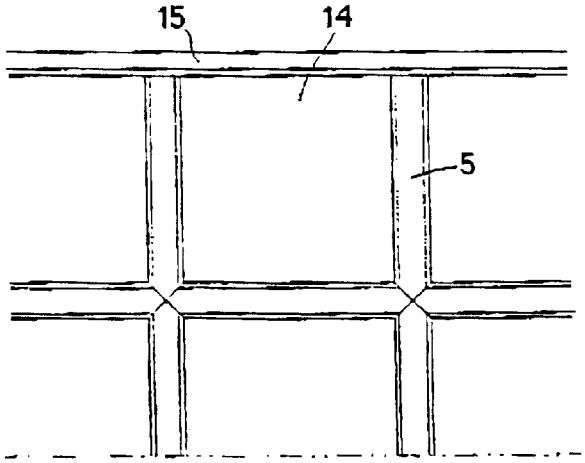

FIG. 1 a cross-section of a panel according to a first preferred embodiment;

FIG. 2 a cross-section of a panel according to a second preferred embodiment;

FIG. 3 a front view of a panel according to the invention with vertical, parallel panel members; and FIG. 4 a front view of a panel according to the invention with plate-shaped panel members separated and framed by cover members.

DETAILED DESCRIPTION OF THE PREFERRED EMBODIMENTS OF THE INVENTION

FIG. 1 shows a cross-section through a panel according to a first preferred embodiment. The panel comprises panel members 1 which may suitably be panel boards having a thickness of 3–5 mm. In the embodiment shown, the panel boards are completely flat on the rear as well as the front face and are fastened by their rear face to a backing 2, e.g. a ceiling or a wall, by the intermediary of double-sided adhesive tape 3. The numeral 4 designates a spacer with a rectangular cross-section. The spacer is disposed between two adjacent panel boards and, in this embodiment, has a thickness which is greater than that of the panel boards. The numeral 5 designates a cover member or cover strip, preferably made of wood, which is centred over the spacer. The centring is achieved by the cover strip 5 exhibiting a groove 6 on its rear face, the groove having essentially the same width as the spacer and a depth which is essentially as great as or somewhat smaller than the difference in thickness between the spacer 4 and the panel boards 1. The cover strip is attached by means of double-sided adhesive tape 7 between the outside of the spacer 4 and the bottom of the groove 6 of the cover strip 5. This design permits centring of the cover strip by the opposite side edges 8 of the groove coacting with the side edges of the spacer. It also permits adhesion of the cover strip to the spacer prior to or simultaneously with the application of the rear face of the cover strip to the front face of the panel boards.

Next, reference is made to FIG. 2, which shows an embodiment where the spacer 4 has a thickness which is smaller that the thickness of the panel boards 1. For this reason, on its rear face, the cover strip 5 exhibits a ridge or thickening 9 of essentially equal or somewhat smaller width than that of the spacer. The height of the ridge or thickening is essentially equal to or somewhat greater that the difference in thickness between the spacer and the panel boards. In this case, too, the cover strip is fastened by means of double-sided adhesive tape 7 between the spacer and the cover strip. This design of the panel permits centring of the cover strip over the spacer by the opposite side edges 10 of the ridge coacting with side edges of the panel boards. Moreover, the design ensures that the cover strip adheres to the double-sided adhesive tape prior to or at the latest at the same time as the rear face of the cover strip is applied to the front face of the panel boards.

FIG. 3 is a front view of a wall on which panelling according to the present invention is being installed. This is carried out by applying parallel strips of double-sided adhesive tape 3 to the backing 2. Subsequently, panel boards 1 and spacers 4 are attached alternatively so that a gap 11 forms between each panel board. In the embodiment shown, in order to economise on materials, the spacers are designed in the form of short pieces of essentially the same length as the strip width of the double-sided adhesive tape 3. Optionally, the panel can be designed with the spacers thicker than the panel boards, as shown in FIG. 1, or thinner than the panel boards as shown in FIG. 2. Subsequent to installing panel boards and spacers on a large part of or on a whole wall, a skirting board 12 can be attached, suitably by means of double-sided adhesive tape, to the outside of the lower ends of the panel boards. Subsequently, cover strips 5 are attached to the spacers in the manner described above, and are finished against the skirting board. In this way, no dust-collecting pockets will form between the skirting board and the panel boards in the areas between the cover strips. Finally, a cornice 13 is applied, suitably by means of double-sided adhesive tape, to the outside of the upper part of the cover strips. Alternatively, the cornice could also be attached to the panel boards and the cover strips could be finished against the cornice so as to avoid dust-collecting pockets in this area as well, but that would require careful length measuring and cutting of the cover strips in order for them to fit exactly between the skirting board and the cornice without any gaps.

The invention is not limited to embodiments where the panel has the shape of elongate, parallel members or boards mounted vertically, horizontally or diagonally. It is also applicable to panels where the panel members are more or less plate-shaped where the length and width are the same or not markedly different from each other. FIG. 4 shows an example of such an embodiment where a plate-shaped panel member 14 is suitably attached by means of double-sided adhesive tape to a backing. Between adjacent panel members, spacers (not shown in the Figure) are arranged having a thickness which differs from the thickness of the panel members. Cover strips 5 having grooves or ridges on the rear face in the manner described above, are centred over the spacers and cover the space between adjacent panel members. The Figure shows an upper strip 15 which in practice can be a cornice or an upper finishing strip of a wainscot which normally has a height of 120–150 cm above floor level.

What is claimed is:

1. A panel comprising:

a plurality of panel members applied to a backing, spacers applied to the backing between adjacent panel members in order to position the panel members spaced from each other by a gap, and cover members applied over the gap between two adjacent panel members, each of the cover members having a width which is greater than a width of a respective one of the spacers, wherein the spacers have a thickness different from that of the panel members, the spacers including spacers that are thicker than the panel members, wherein when the spacers are thicker than the panel members the cover members include a groove on a rear face of the cover members, wherein the groove is essentially as wide as the spacer and has opposite limiting edges, which in coaction with edge portions of the spacer and of the adjacent panel members, respectively, achieves centering of the cover member over the spacer and the gap.

2. A panel according to claim 1, wherein the panel members are fastened to the backing by means of double-sided adhesive tape.

3. A panel according to claim 1, wherein the cover member is fastened to the spacers by means of double-sided adhesive tape and the groove has a depth which is essentially as great as or smaller than the difference in thickness between the spacers and the panel members.

4. A panel according to claim 1, wherein the spacers are markedly shorter than the panel members and at least two spacers are arranged between each pair of adjacent panel members.

5. A panel according to claim 1, wherein the spacers exhibit through-grooves or through-holes parallel to the panel members in order to facilitate air circulation in the gap.

6. A method for mounting a panel of the type comprising a plurality of panel members applied to a backing, with spacers between individual panel members in order to position the panel members with a gap in relation to each other, and cover members applied over the gap between adjacent panel members, with each of the cover members having a width which is greater than the width of a respective one of the spacers, the method comprising the steps of:

applying a first panel member to the backing, providing at least one spacer with a thickness which is different from a thickness of the first panel member and applying the at least one spacer immediately adjacent to the first panel member, applying a second panel member immediately adjacent to the at least one spacer, providing a cover member including at least one of a longitudinal groove and a ridge on a rear face thereof, wherein when the spacer is thicker than the first and second panel members, the cover member includes the longitudinal groove, and when the spacer is thinner than the first and second panel members, the cover member includes the ridge, wherein at least one of the groove and the ridge is essentially as wide as the spacer and has opposite limiting edges, and applying the cover member over the gap in such a way that the limiting edges of at least one of the groove and the ridge of the cover member coact with edge portions of at least one of the spacers and the adjacent panel members in centering the cover member over the gap.

7. A method according to claim 6, further comprising the step of fastening the panel members and the spacers to the backing by means of double-sided adhesive tape.

8. A method according to claim 6, further comprising the step of fastening the cover members to the spacers by means of double-sided adhesive tape.

9. A panel comprising:

a plurality of panel members applied to a backing, spacers applied to the backing between adjacent panel members in order to position the panel members spaced from each other by a gap, and cover members applied over the gap between two adjacent panel members, each of the cover members having a width which is greater than a width of a respective one of the spacers, wherein the spacers have a thickness different from that of the panel members, the spacers including spacers that are thinner than the panel members, wherein when the spacers are thinner than the panel members, the cover members include a ridge on a rear face of the cover members, and wherein the ridge is essentially as wide as the spacer and has opposite limiting edges, which in coaction with edge portions of the spacer and of the adjacent panel members, respectively, achieves centering of the cover member over the spacer and the gap.

10. A panel according to claim 9, wherein the panel members are fastened to the backing by means of double-sided adhesive tape.

11. A panel according to claim 9, wherein the cover members are fastened to the spacers by means of double-sided adhesive tape and the ridge has a height which is essentially as great as or greater than the difference in thickness between the spacers and the panel members.

12. A panel according to claim 9, wherein the spacers are markedly shorter than the panel members and at least two spacers are arranged between each pair of adjacent panel members.

13. A panel according to claim 9, wherein the spacers exhibit through-grooves or through-holes parallel to the panel members in order to facilitate air circulation in the gap.

* * * * *